US005725467A

United States Patent [19]

Chehab et al.

[11] Patent Number: 5,725,467

[45] Date of Patent: Mar. 10, 1998

[54] METHOD OF AND APPARATUS FOR MAKING A TOW OF FILTER MATERIAL FOR TOBACCO SMOKE

[75] Inventors: Firdausia Chehab, Hamburg; Stefan Fietkau, Westerau; Peter-Franz Arnold, Hamburg, all of Germany

[73] Assignee: Hauni Maschinenbau AG, Hamburg, Germany

[21] Appl. No.: 557,462

[22] Filed: Nov. 14, 1995

[30] Foreign Application Priority Data

Dec. 9, 1994 [DE] Germany ..... 44 43 866.4

[51] Int. Cl.[6] ..... B31C 13/00

[52] U.S. Cl. ..... 493/42; 493/43; 493/44; 493/49; 493/50

[58] Field of Search ..... 493/39–50

[56] References Cited

U.S. PATENT DOCUMENTS

| | | | |
|---|---|---|---|
| T665,476 | 3/1969 | Morrison et al. . | |
| 3,255,506 | 6/1966 | Fritz . | |
| 3,317,965 | 5/1967 | Murakami . | |
| 3,494,263 | 2/1970 | Tachibana et al. | 493/41 |
| 3,800,676 | 4/1974 | Levers et al. | 493/44 |
| 3,817,211 | 6/1974 | Brown et al. . | |
| 3,960,645 | 6/1976 | Brackmann et al. | 493/42 |
| 3,971,695 | 7/1976 | Block | 493/44 |
| 3,974,007 | 8/1976 | Greve | 493/44 |
| 4,046,064 | 9/1977 | Wahle | 493/44 |
| 4,259,130 | 3/1981 | Lebet | 493/45 |
| 4,259,769 | 4/1981 | Greve et al. . | |
| 4,281,671 | 8/1981 | Byrne et al. | 493/49 |
| 4,511,420 | 4/1985 | Arthur . | |
| 4,522,616 | 6/1985 | Hyde et al. | 493/50 |
| 4,537,583 | 8/1985 | Pryor | 493/42 |
| 4,549,875 | 10/1985 | Pryor | 493/49 |
| 4,699,606 | 10/1987 | Whitney, Jr. et al. | 493/42 |
| 5,060,664 | 10/1991 | Siems et al. . | |
| 5,116,298 | 5/1992 | Bondanelli et al. | 493/40 |
| 5,234,397 | 8/1993 | Wahle | 493/47 |
| 5,429,575 | 7/1995 | Armour et al. | 493/48 |

FOREIGN PATENT DOCUMENTS

| | | |
|---|---|---|
| 4240089 | 1/1994 | Germany . |
| 42 40 089 A1 | 6/1994 | Germany . |

*Primary Examiner*—Joseph J. Hail, III
*Assistant Examiner*—Darren Ark
*Attorney, Agent, or Firm*—Darby & Darby

[57] ABSTRACT

The treatment of a tow of filamentary filter material for tobacco smoke prior to draping of the resulting filler into a web of wrapping material is followed by advancement of the filler in a plane and single or multiple deflection of successive increments of the filler from and transversely of the plane. The deflected increments are returned into the plane and are advanced into the draping unit. Deflection of successive increments of the filler reduces the likelihood of the so-called towsplit which denotes the separation of partially bonded and gathered filaments from each other.

17 Claims, 2 Drawing Sheets

METHOD OF AND APPARATUS FOR MAKING A TOW OF FILTER MATERIAL FOR TOBACCO SMOKE

BACKGROUND OF TEE INVENTION

The invention relates to improvements in methods of and in apparatus for manipulating filter material for tobacco smoke. More particularly, the invention relates to improvements in methods of and in apparatus for manipulating fibrous filter material which is supplied in the form of a flow (such as a flat layer compacted into a bale of standard dimensions) and is manipulated on its way toward a wrapping or other filler processing station which is to receive a substantially rod-shaped filler or tow of filter material. A wrapped filler or tow is ready to be subdivided into rod-shaped sections of unit length or multiple unit length for delivery to a filter tipping machine serving to turn out filter cigarettes, cigarillos or other smokable rod-shaped articles of the tobacco processing industry.

As a rule, a continuous layer or flow of filamentary filter material for tobacco smoke (such as cellulose acetate fibers) is drawn from a bale and is subjected to a series of treatments including spreading or banding with compressed air or another gaseous fluid, stretching between spaced-apart sets of rollers to thus move the filaments of the running flow or layer into positions of at least substantial parallelism with each other, the application of a suitable solvent (such as triacetin) to soften portions of neighboring fibers in the spread-out and stretched flow, and thereafter causing successive increments of the flow to advance through a gathering device which enables neighboring filaments of the flow to adhere to each other and to thus establish a maze of paths for the flow of tobacco smoke through the fillers of filter mouthpieces which contain the thus treated filamentary filter material. The flow advancing components of the apparatus are normally designed and assembled in such a way that successive increments of the flow leaving the gathering station are advanced in a plane toward and into the filler processing station (such as the aforementioned filler wrapping station wherein the filler is draped into a web of imitation cork or other suitable wrapping material to form therewith a continuous filter rod ready to be subdivided into sections of desired length).

Apparatus of the above outlined character are disclosed, for example, in U.S. Pat. Nos. 4,511,420 and 5,060,664. The disclosures of these patents and all other U.S. patents mentioned in this specification are incorporated herein by reference. The gathering of filaments of filter material which carry droplets of atomized plasticizer takes place in a so-called horn which directs successive increments of the freshly obtained substantially rod-shaped filler or tow directly into the wrapping device. Published German patent application No. 42 40 089 A1 discloses a somewhat modified apparatus wherein successive increments of the partially plasticized flow of filamentary filter material are gathered upstream of the horn of the wrapping device. The horn of the wrapping device constitutes a second gathering unit wherein successive increments of the flow about to enter the wrapping station are condensed or gathered for a second time prior to coming into contact with the web of wrapping material.

Apparatus of the above outlined character are well known in the tobacco processing industries. The assignee of the present application distributes filter tow or filler making apparatus (known as AF1, AF2 and AF3) which are used in filter rod making machines, e.g., in machines known as KDF2 and KDF3 (supplied by the assignee).

A drawback of presently known apparatus for the manipulation of flows of filamentary filter material for tobacco smoke is that they cannot invariably and/or completely prevent the so-called towsplit which is likely to adversely affect the quality of filter mouthpieces. The term towsplit is intended to denote that portion or those portions of a filler or tow of filamentary filter material wherein the previously bonded-together filaments become separated from each other downstream of the single or last gathering station. This can result in the establishement of unduly large paths for the flow of tobacco smoke through mouthpieces embodying such fillers or tows. In addition, towsplit is likely to cause undesirable variations of density of fillers forming part of filter mouthpieces for cigarettes or other rod-shaped articles of the tobacco processing industry.

OBJECTS OF THE INVENTION

An object of the invention is to provide a novel and improved method which renders it possible to prevent separation of neighboring filaments in a filler or tow of filter material from each other prior and/or subsequent to entry into a filter rod making machine.

Another object of the invention is to provide a novel and improved method of manipulating a flow or layer of filamentary filter material for tobacco smoke immediately or shortly prior to entry of successive increments of such flow into the wrapping mechanism of a filter rod making machine.

A further object of the invention is to provide a method which involves a novel and improved treatment of a flow or layer of filamentary filter material for tobacco smoke between the plasticizing and wrapping stations of a filter rod making machine.

An additional object of the invention is to provide a method which exhibits all advantages of presently known methods and further at least greatly reduces the likelihood of the development of the so-called towsplit.

Still another object of the invention is to provide a method which ensures that the density of fillers forming part of filter mouthpieces for tobacco smoke at least approximates a desired optimum density.

A further object of the invention is to provide a novel and improved apparatus for the practice of the above outlined method.

Another object of the invention is to provide a filter rod making machine which embodies the improved apparatus.

An additional object of the invention is to provide an apparatus which can be utilized in standard filter rod making machines as a superior substitute for existing apparatus.

Still another object of the invention is to provide the apparatus with novel and improved means for manipulating successive increments of a flow of filamentary filter material for tobacco smoke immediately or shortly prior to entry into the wrapping device or mechanism of a filter rod making machine.

A further object of the invention is to provide the above outlined apparatus with novel and improved means for influencing the cross-sectional outline of successive increments of a plasticized flow of filamentary filter material ahead of the wrapping station.

Another object of the invention is to provide the apparatus with novel and improved means for influencing the density of the filler in a filter rod for the making of filter rod sections of desired length.

An additional object of the invention is to provide a rod-like filler of filamentary filter material for tobacco smoke which is produced in accordance with the above outlined method.

Still another object of the invention is to provide a rod-like filler for use in filter mouthpieces for tobacco smoke which is produced in the above outlined apparatus and which exhibits an optimum density and does not exhibit a tendency to develop the aforediscussed towsplit.

SUMMARY OF THE INVENTION

One feature of the present invention resides in the provision of a method of making a substantially rod-like filler of filter material (e.g. filaments of cellulose acetate) for tobacco smoke. The method comprises the steps of advancing a continuous flow (e.g. a flat layer) of filamentary filter material along a first path through a series of processing stations, and moving the processed flow through a filler processing station (e.g., through a device wherein the filler is draped into a continuous web of wrapping material such as imitation cork or the like) along a second path. The first path includes a section which merges into the second path and the advancing step includes advancing successive increments of the flow through the aforementioned section of the first path in a predetermined plane (e.g., in an at least substantially vertical plane) and deflecting the successive increments at least once from and at least substantially transversely of the plane.

The draping of the continuous web of wrapping material around the filler results in the formation of a continuous filter rod, and the method can further comprise the step of subdividing the filter rod into a series of filter rod sections of predetermined (such as unit or multiple unit) length.

The advancing step can further comprise spreading out the flow (e.g., by resorting to one or more pneumatically operated so-called banding devices), applying to the spread-out flow a plasticizer (e.g., triacetin) for filamentary filter material, and thereupon gathering the thus partially plasticized flow upstream of the aforementioned plane to convert the flow into a substantially rod-like stream or tow which advances along the aforementioned section of the first path.

The deflecting step can include repeatedly deflecting successive increments of the flow substantially transversely of the aforementioned plane. Furthermore, the deflecting step can include returning the at least once deflected increments of the flow into the predetermined plane prior to entry of such increments into the second path.

The deflecting step preferably involves a reduction of the cross-sectional area of the flow, i.e., the cross-sectional area of successive increments of the flow entering the predetermined plane is preferably less than the cross-sectional area of successive increments entering the second path.

The deflecting step can include at least two successive deflecting stages or steps. Each stage of the deflecting step can involve a reduction of the cross-sectional areas of successive increments of the flow to less than the cross-sectional area of the flow upstream of the predetermined plane or upstream of the instrumentalities which are used to carry out the multi-stage deflecting step.

The step of advancing successive increments of the flow in the predetermined plane can include changing the direction of advancement of successive increments of the flow at least once in (i.e., within) the predetermined plane.

Another feature of the invention resides in the provision of an apparatus for making a substantially rod-like filler of filter material for tobacco smoke. The apparatus comprises a source of a continuous flow of filamentary filter material and means for advancing the flow from the source first along a first path and thereupon along a second path. The second path preferably extends through a filler processing station, and the first path has a (last) section which merges into the second path. The apparatus further comprises means for spreading, processing (such as plasticizing) and gathering successive increments of the flow in the first path ahead of the last section, and the advancing means includes means for maintaining the flow in a predetermined plane along a portion of the last section of the first path. The apparatus further comprises means for deflecting successive increments of the flow at least once from and transversely of the predetermined plane.

The predetermined plane is or can be at least substantially vertical.

The means for deflecting can include means for repeatedly deflecting the flow in different directions. For example, the means for deflecting can include means for deflecting successive increments of the flow first in a first direction and thereupon in a second direction at least substantially counter to the first direction. For example, the means for deflecting can include at least one sheave or pulley having a circumferentially extending endless channel or groove for successive increments of the flow. In accordance with a presently preferred embodiment of the improved apparatus, the means for deflecting includes a first pulley or sheave having a first circumferential groove of a first width and a second pulley or sheave having a second circumferential groove of a second width less than the first width. The flow is trained first around or over the first sheave and thereupon around or over the second sheave.

The means for deflecting can include a plurality of guides which are arranged to divert or deflect successive increments of the flow from the predetermined plane first in a first direction, thereupon in a second direction at least substantially counter to the first direction, and thereupon back into the predetermined plane. Each guide can include or constitute a pulley or sheave, and each such pulley or sheave is preferably provided with a circumferential channel or groove for successive increments of the flow of filamentary filter material in the last section of the first path.

The apparatus can further comprise means for changing the direction of movement of successive increments of the flow in the predetermined plane. Such direction changing means can include at least one rotary pulley or sheave having a circumferentially complete channel or groove for the flow of filter material advancing toward the second path. The arrangement can be such that the means for changing is located upstream or downstream of the deflecting means as seen in the direction of advancement of successive increments of the flow along the last section of the first path and toward the second path under the action of the advancing means.

The source of filamentary filter material can include at least one bale of compacted filter material and the flow being advanced from the at least one bale can include a substantially flat tow of filamentary filter material.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of several presently preferred specific embodiments with reference to the accompanying drawings.

DESCRIPTION OF PREFERRED EMBODIMENTS

Figure 1:
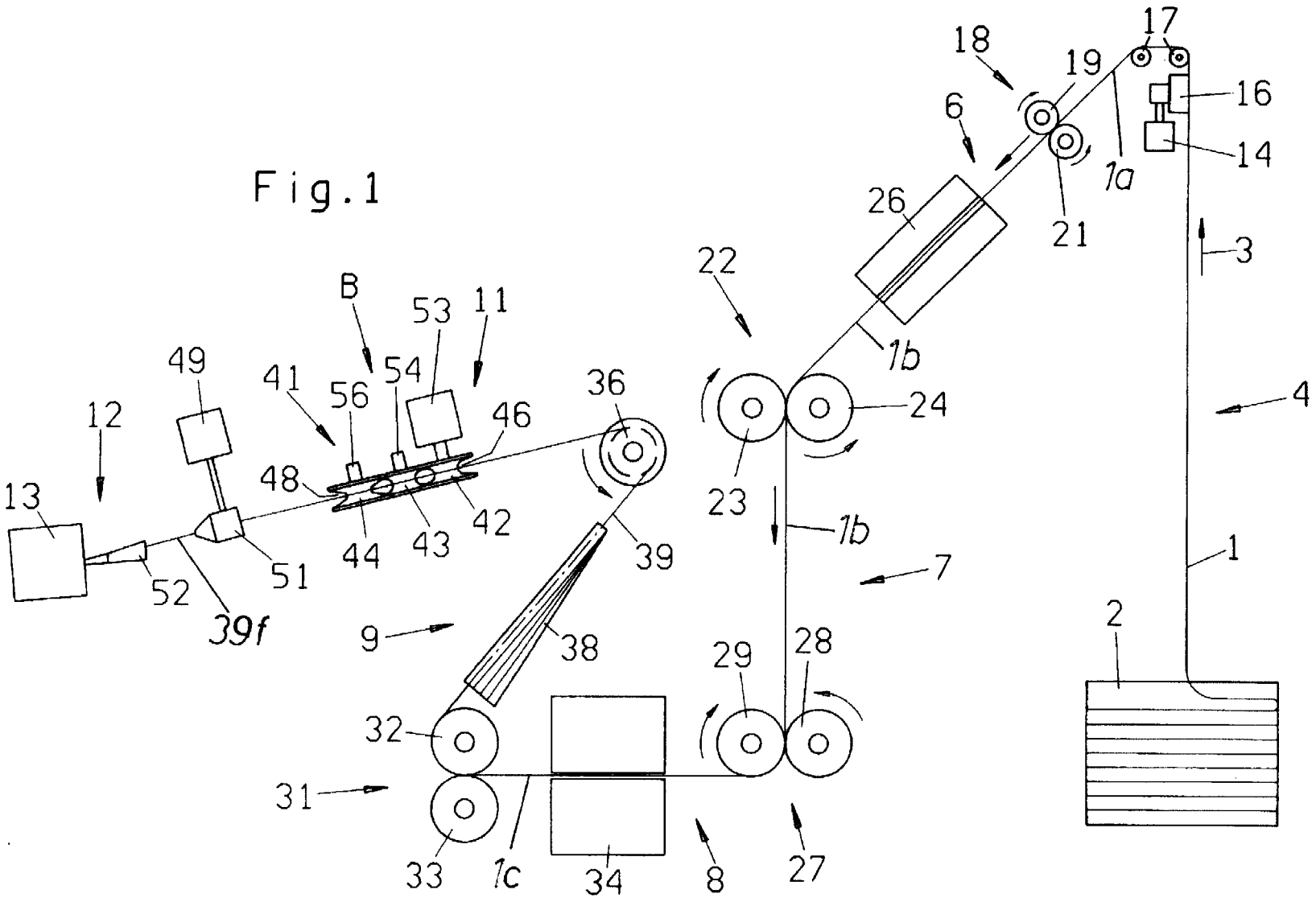
FIG. 1 is a schematic elevational view of an apparatus which embodies one form of the invention and wherein the means for deflecting the flow of filamentary filter material comprises three rotary sheaves.

FIG. 1 shows an apparatus which serves to convert a continuous layer or flow 1 of filamentary filter material into a substantially rod-like filler or tow 39*f*. Such filler is ready to enter the wrapping device or mechanism 13 of a filter rod making machine wherein the filler is draped into a continuous web of suitable wrapping material (such as cigarette paper or imitation cork) to form therewith a continuous filter rod. The rod is divided into a series or file of filter rod sections of unit length or multiple unit length ready to be fed into the magazine of a filter tipping machine or another machine wherein the filter rod sections are assembled with plain cigarettes, cigars, cigarillos or other tobacco-containing articles. For example, the filter flow converting apparatus and the wrapping mechanism 13 of FIG. 1 can form part of a filter rod production line such as Hauni AF 2/KDF 2 which is distributed by the assignee of the present application.

In the apparatus of FIG. 1, the source of filamentary filter material includes a bale 2 of compacted cellulose acetate fibers. The layer 1 is advanced in the direction of arrow 3 first along an elongated first path extending from the bale 2 to a gathering horn 52 and thereupon along a second path extending through and beyond the wrapping mechanism 13. The horn 52 receives successive increments of the filler or tow 39*f* from the neighboring last section of the first path.

Successive increments of the layer or flow 1 leaving the bale 2 are caused to move upwardly along a first section or portion 4 of the first path toward and past one or more so-called spreading or banding devices 16 (only one shown in FIG. 1) serving to increase the width of and to loosen the flow. To this end, each banding device 16 receives at least one stream of compressed gaseous fluid (such as air) from a suitable source 14. The first portion or section 4 of the first path is followed by a second portion or section 6 wherein the filaments of the banded layer are dried prior to entering a third portion or section 7 wherein the filaments are subjected to one or more stretching treatments. The section or portion 7 of the first path is followed by a section or portion 8 wherein the stretched filaments are contacted by minute droplets of an atomized plasticizer (such as triacetin) prior to entering the next-following (next-to-the-last) portion or section 9 wherein they are compelled to advance through a suitable gathering device 38. The treatments to which successive increments of the layer or flow 1 are subjected in the sections 4, 6, 7, 8 and 9 of the first path are or can be identical with or similar to those a flow of filter material is subjected during advancement through the aforementioned production line Hauni AF 2/KDF 2 or a production line known as Hauni AF 3E/KDF 3e (also distributed by the assignee of the present application).

The banding device 16 can be of the type disclosed in commonly owned U.S. Pat. No. 4,259,769. Succesive freshly banded increments of the layer or flow 1 are trained over guide rollers 17 which direct them toward the nip of idler or driven rollers 19, 21 forming part of the first unit 18 of composite advancing means for the filamentary filter material.

The apparatus which is actually shown in FIG. 1 is constructed and assembled in such a way that the flow 1 is subjected to two successive stretching actions or treatments, namely first during advancement of its increments along the section 6 and thereupon along the section 7 of the first path. The composite advancing means comprises the aforementioned first unit 18, a second unit 22 (including rollers 23, 24), a third unit 27 (including rollers 28, 29) and a fourth unit 31 which includes rollers 32, 33.

The rollers 23, 24 of the unit 22 are driven by a variable-speed electric motor (or another suitable prime mover, not shown) so that they can subject the flow 1 between the advancing units 18, 22 to a desired stretching action while the increments of the flow advance through a dryer 26. The rollers 19, 21 of the unit 18 need not be driven, i.e., they are rotated by the filamentary filter material which is being pulled by the driven rollers 23, 24 of the unit 22. The resistance which the rollers 19, 21 offer to rotation under the action of the flow 1 advancing toward and through the dryer 26 is or can be adjustable within desired limits. It is equally possible to positively drive the rollers 19, 21 at a selected speed (or at any one of a plurality of different speeds) which is less than the peripheral speed of the driven rollers 23, 24. As a rule, or at least in many instances, it suffices to equip the unit 18 with suitable brakes which cause the rollers 19, 21 to offer a desired resistance to rotation under the action of the advancing flow 1.

Preliminary stretching between the advancing units 18 and 22 contributes to uniformity of the flow 1 and entails a widening of the flow in a direction at right angles to the plane of FIG. 1. This is desirable in connection with the application of atomized plasticizer by the device 34 between the advancing units 27 and 31. The dryer 26 is preferably a conditioner which ensures that the moisture content of the flow 1 reaching the nip of the rollers 23, 24 is at least substantially constant regardless of the selected peripheral speed of the rollers 23 and 24. A dryer or conditioner which can be utilized with advantage in the apparatus of FIG. 1 to maintain the water content of successive increments of the flow 1 reaching the advancing unit 22 at a desired (particularly constant) value is known as "Weko-Heat-Trockner" and is distributed by the Firm Haug GmbH & Co. KG, P.O.Box 200333, D-70771 Leinfelden (Echterdingen), Federal Republic Germany.

The second section 6 of the first path for the flow 1 can accommodate one or more additional devices which are designed to treat successive increments of the flow upstream and/or downstream of the dryer 26. For example, the flow 1 can advance past one or more devices for the application of high-potential electrostatic charges which are designed to ensure separation of any filaments which continue to adhere to each other downstream of the banding device 16 and in spite of the stretching action of the advancing units 18, 22. The electrostatic charges which are imparted to the filaments tend to repel the filaments from neighboring filaments to thus further improve the circumstances for the application of atomized plasticizer by the device 34 in the section 8 of the first path for the flow 1. Suitable electrostatic charging devices are disclosed, for example, in U.S. Pat. No. 3,817,211 and in the Defensive Publication No. 665,476 on page 860/3 of the Mar. 18, 1969 issue of the Official Gazette of the United States patent and Trademark Office.

The third section 7 of the first path for the flow 1 is or can be vertical or substantially vertical and serves for additional or final stretching or elongation of filaments on their way toward the plasticizer applying device 34. The lower end of the section 7 is defined by the nip of rollers 28, 29 forming part of the advancing unit 27. The rollers 28, 29 are driven by a variable-speed electric motor or by any other suitable prime mover, not shown, and their peripheral speed at least slightly exceeds the peripheral speed of the rollers 23, 24 to ensure that the flow 1 is subjected to a desired stretching action upstream of the plasticizer applying device 34, namely to the selected maximum stretching action. The manner in which the continuously advancing flow 1 is being stretched between the advancing units 18, 22 and/or between the advancing units 22, 27 is or can be the same as in the apparatus AF1, AF2 and AF3 which are distributed by the assignee of the present application. Reference may also be had to U.S. Pat. Nos. 3,317,965 and 3,255,506. It has been found that the final stretching action is particularly satisfactory if the length of the third section 7 of the first path for the flow 1 is between about 800 and 1200 mm, preferably about 1000 mm.

The rollers 32, 33 of the advancing unit 31 are preferably driven by a variable-speed electric motor or another suitable prime mover and their peripheral speed is or can be less than the peripheral speed of the rollers 28, 29. In other words, the rollers 32, 33 of the unit 31 enable the flow 1 to relax, at least slightly, during advancement of its increments through or past the plasticizer applying device 34. The path section 8 which extends through or along the device 34 is or can be at least substantially horizontal. A presently preferred plasticizer which effects localized softening of filaments of the stretched tow is triacetin.

The manner in which the rollers of several successive advancing units for a flow of filamentary filter material for tobacco smoke can be driven at different speeds is disclosed, for example, in commonly owned U.S. Pat. No. 3,974,007. This patent further discloses a plasticizer applying device which can be utilized at 34 in the apparatus of the present invention.

The fifth section 9 of the first path for the flow 1 is located in a predetermined plane (such as in the plane of FIG. 1) and successive increments of the flow are caused to advance therein vertically upwardly or with a pronounced vertical component of movement. The upper end of the section 9 is defined by the circumferentially complete groove or channel (see also FIG. 2) in the peripheral surface of a further unit 36 of the flow advancing means, namely a pulley or sheave which is rotatable about a horizontal axis. The gathering device 38 in the path section 9 serves to reduce the width of the repeatedly treated flow and converts the latter into a substantially rod-like stream 39 which is trained over the pulley 36 on its way toward the horn 52 at the inlet to the filler wrapping device 13 at the filler processing station 12 which is adjacent the second path. The device 38 can include a series of successive gathering elements in the form of wire loops having progressively smaller diameters to effect a gradual gathering of filaments issuing from the nip of the rollers 32, 33 into the stream 39 entering the peripheral groove of the pulley 36.

The gathering device 38 which is shown in FIG. 1 comprises a tubular guide having longitudinally extending splines which alternate with longitudinally extending ribs to define an elongated gradually narrowing passage for the plasticizer-bearing increments of the repeatedly treated flow advancing toward the pulley 36. The cross-sectional area of the flow undergoes a change during advancement through the gathering device 38 and such area resembles the cross-sectional area of successive increments of the tow or filler 39*f* which enter into and advance through and beyond the horn 52.

As can be seen by looking at FIG. 1, the first five sections 4, 6, 7, 8 and 9 of the first path are located in a vertical or nearly vertical plane, and this also holds true for a part of the last section 11 extending between the pulley 36 and the horn 52. In other words, the flow 1 advances vertically upwardly from the bale 2 toward the rollers 17, and the banded increments la of the flow 1 advance downwardly (but in the same plane) toward the nip of the rollers 19, 21. The repeatedly stretched portions 1*b* of the flow 1 advance toward and beyond the nip of the rollers 28, 29, and the partially plasticized portions or increments 1*c* of the flow advance (again in the same plane) beyond the plasticizer applying device 34 into the path section 9 wherein they move upwardly to form the stream 39 which is trained over and advances beyond the pulley 36. The just discussed plane is an imaginary plane wherein successive increments of the flow 1 advance from the bale 2 toward and beyond the pulley 36 and, with certain notable interruptions, into and through the horn 52 to enter the wrapping mechanism 13 at the processing station 12 for the filler or tow 39*f*.

The purpose of the plasticizer which is being atomized in and applied by the device 34 is to soften numerous portions of cellulose acetate fibers advancing from the unit 27 toward the unit 31. The thus softened portions of fibers are caused to adhere to portions of the neighboring fibers and to establish a maze of minute paths for the flow of tobacco smoke through the filler of a finished filter mouthpiece when a cigarette or another rod-shaped article embodying the filter mouthpiece is lighted. Adherence of portions of neighboring fibers or filaments to each other is promoted (and such filaments are caused to be bonded to each other) as a result of gathering during advancement from the advancing unit 31 toward and around the pulley 36. The application of atomized plasticizer not only ensures the establishment of a large number of minute paths for the flow of tobacco smoke but also enhances the stability of the filler 39 which advances through and beyond the horn 52.

An examination of fillers which are produced in heretofore known apparatus and by resorting to heretofore known methods reveals that the density of the fillers is not uniform across the entire cross-sectional area of the filler in the tubular wrapper of a filter mouthpiece. Such examination further reveals that the zones of lesser density are located in certain planes of the tested fillers. For example, and in the absence of any undertakings to the contrary, a zone of lesser density would be likely to be found in a vertical plane halving the rod-like stream 39 downstream of the pulley 36. The reason is that the bonds between portions of neighboring filaments in one or more planes are weakened, and such weakening can reach proportions which are sufficient to result in breaking apart of the filler or of sections of filter material forming part of such filler in a finished filter mouthpiece. The zones or regions of reduced density are known or designated as "towsplit". The quality of such zones is unsatisfactory for several reasons. Thus, and as already pointed out above, absence of sufficient adherence of portions of neighboring filaments to each other detracts from the stability of filter mouthpieces as well as from the tobacco smoke filtering action of fillers in such mouthpieces.

It has been discovered that the development of towsplit is prevented, or the likelihood of such development at least greatly reduced, by novel and improved manipulation of successive increments of the stream 39 by the pulley 36 as well as in the path section 11 between the pulley 36 and the wrapping mechanism 13. To this end, the means for advancing the flow 1 from the bale 2 to the horn 52 further comprises a unit 41 which guides successive increments of the stream 39 along the sixth section 11 of the first path. The component parts of the unit 11 are shown in FIG. 1 and, drawn to a somewhat larger scale, in FIG. 2 of the drawings.

Figure 2:
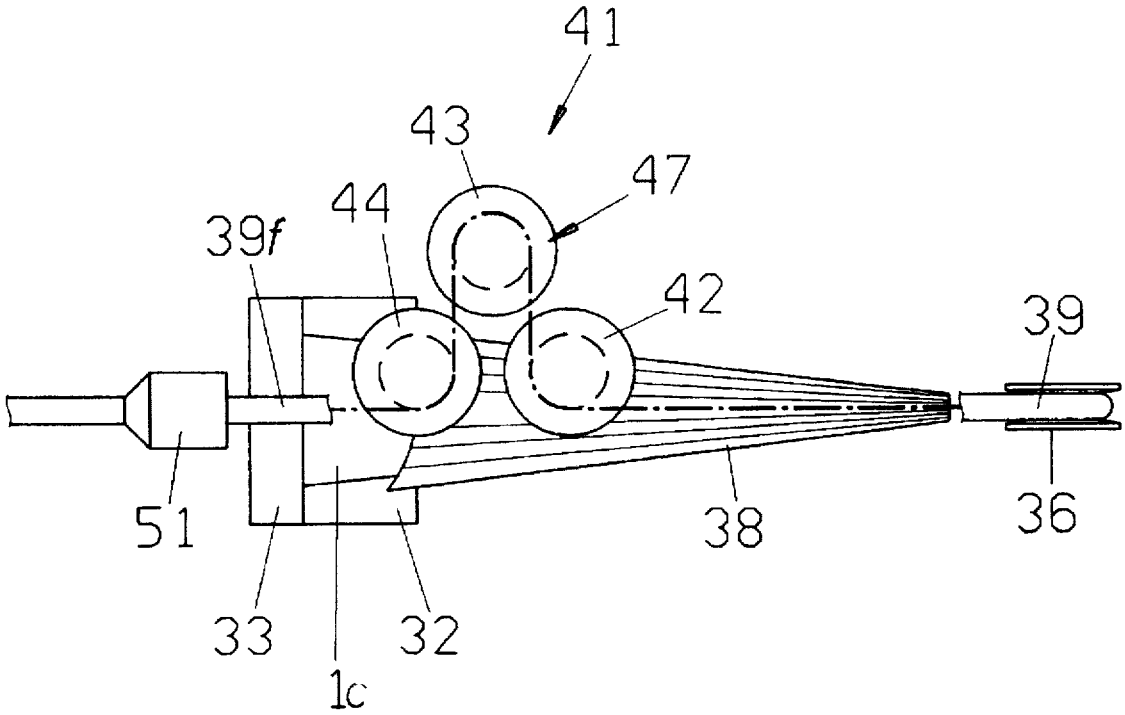
FIG. 2 is an enlarged plan view of the deflecting means substantially as seen in the direction of arrow B in FIG. 1.

The advancing unit 41 which is shown in FIGS. 1 and 2 comprises three rotary guides 42, 43, 44 in the form of pulleys or sheaves (hereinafter called sheaves) which are positioned and configurated to repeatedly deflect the stream 39 from and at least substantially transversely of the aforementioned plane. The sheaves are located in a plane which is normal to the plane of FIG. 1, and they are driven by suitable prime movers including a variable-speed electric motor 53 for the sheave 42. The sheave 43 and/or 44 can be driven by a discrete prime mover or by the motor 53 through the intermediary of a suitable transmission, not shown. The shafts 54 and 56 which are shown in FIG. 1 can be said to constitute rotary output elements of two discrete prime movers for the sheaves 43 and 44, respectively.

Successive increments of the stream 39 advancing beyond the pulley 36 are trained over the sheaves 42, 43 and 44 in such order. The sheave 42 deflects the stream 39 from the plane of FIG. 1 into a second plane which is normal to the plane of FIG. 1 and in a first direction, namely upwardly (FIG. 2) from a straight line connecting the groove of the pulley 36 with the inlet of the horn 52. The sheave 43 deflects the stream 39 in a second direction at least nearly counter to the first direction, and the sheave 44 returns the stream 39 into the first plane wherein the thus obtained filler or tow **39*f* advances toward and through the horn 52**.

Repeated deflection of the stream 39 in directions transversely of the first plane results in a narrowing of the stream, and more specifically in a reshaping of its cross section from a somewhat circular (at the outlet of the gathering device 38) to a truly or practically circular cross section at the horn 52. Such narrowing or reshaping of the cross section of the stream 39 ensures more satisfactory bonding of portions of filaments to portions of neighboring filaments to thus greatly reduce the likelihood of or to actually prevent the development of towsplit. This, in turn, reduces the tendency of the filler or tow **39*f*** to develop portions having different densities. Predictable density of a rod-like filler in a filter mouthpiece greatly enhances the ability of the filter mouthpiece to filter the tobacco smoke in a predetermined and optimum fashion.

FIG. 1 shows that the width at least of the deepmost portion of the circumferential groove 46 in the peripheral surface of the sheave 42 exceeds the width of the deepmost portion of the circumferential groove 48 in the peripheral surface of the sheave 44. The width of the circumferential groove 47 (FIG. 2) in the peripheral surface of the median sheave 43 is or can be between the widths of the grooves 46 and 48. Such dimensioning of the circumferential grooves 46, 47 and 48 contributes to gradual and more predictable narrowing of the stream 39 on its way from the pulley 36 toward the horn 52. Otherwise stated, the training of the stream 39 over sheaves having grooves the width of which decreases (from sheave to sheave) in a direction from the pulley 36 toward the wrapping mechanism 13 brings about a number of important advantages such as a change of the cross-sectional area of the stream 39 in a series of successive stages, moving of plasticized portions of neighboring filaments of the stream 39 nearer to each other as the stream advances from the gathering device 38 toward the wrapping mechanism 13, the development of a filler **39*f* the density of which is at least substantially uniform across the entire cross section, and the absence of towsplit or any readily noticeable towsplit. All this greatly enhances the quality of the filler 39*f*** and of filter mouthpieces containing rod-shaped sections or portions of such filler.

The sheaves 42, 43 and 44 serve to repeatedly deflect the stream 39 from the plane including the circumferential groove of the pulley 36. On the other hand, the pulley 36 deflects successive increments of the stream 39 in such plane. This, too, enhances the quality of the filler **39*f* because the stream 39 is condensed first in the plane of FIG. 1 prior to being repeatedly condensed in a second plane which is normal to the plane of FIG. 1. In other words, the feature that the stream 39 is trained over the pulley 36 prior to reaching the first sheave 42 even further enhances the quality of the filler 39*f*** by contributing to more uniform density and by preventing or at least minimizing the development of towsplit.

FIG. 1 further shows a nozzle 51 which is installed in the last section 11 of the first path and through which successive increments of the filler **39*f* advance from the circumferential groove 48 of the sheave 44 toward and through the horn 52. The path portion which is defined by the nozzle 51 is or can be located in the plane of FIG. 1. The nozzle 51 is connected to a source 49 of compressed air or another gaseous fluid. The horn 52 does or can ensure a further change in the cross-sectional outline of successive increments of the filler 39*f* advancing from the nozzle 51 toward and into the wrapping mechanism 13**.

It is not always necessary to repeatedly deflect the stream 39 from the first plane, transversely of the first plane and back into the first plane before the thus obtained filler is ready to enter the wrapping mechanism. However, it is often desirable and advantageous to deflect the stream 39 more than once. Deflection of the treated stream 39 (i.e., of the nearly or practically finished filler **39*f*) into the plane of FIG. 1 is not absolutely necessary but is often desirable and advantageous for the sake of simplicity and compactness. Thus, the filler 39*f* can enter the wrapping mechanism 13 by moving in the general plane of treatment of the stream 1 by the banding device or devices 16, in the dryer or conditioner 26, in the plasticizer applying device 34 and in the gathering device 38**.

Another important advantage of the improved method and apparatus is that the quality of the filler **39*f* can be enhanced by the simple and inexpensive expedient of providing the aforementioned advancing unit 41 including the means (such as the aforedescribed sheaves 42, 43 and 44) for preferably repeatedly deflecting successive increments of the stream 39 from the plane of the circumferential groove of the pulley 36**.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outined contribution to the art and, therefore, such adaptations should and are intended to be comprehended within the meaning and range of equivalence of the appended claims.

What is claimed is:

1. A method of making a substantially rod-like filler of filter material for tobacco smoke, comprising the steps of advancing a continuous flow of filamentary filter material along a first path through a series of processing stations, including spreading out the flow, applying to the spread-out flow a plasticizer for filamentary filter material, and thereupon gathering the plasticized flow to convert the flow into a substantially rod-like stream which advances along a section of said first path; and moving said rod-like stream through a filler processing station along a second path, said section of said first path merging into said second path and said advancing step further including advancing successive increments of the flow along said section of said path in a predetermined plane, changing the direction of advancement of said rod-like stream at least once within said predetermined plane, and deflecting said rod-like stream entirely at least once subsequent to said gathering step from and substantially transversely of said predetermined plane.

2. The method of claim 1, wherein said moving step includes draping the filler into a web of wrapping material to form a continuous filter rod, and further comprising the step of subdividing the filter rod into a series of filter rod sections of predetermined length.

3. The method of claim 1, wherein said deflecting step includes repeatedly deflecting said rod-like stream substantially transversely of said predetermined plane.

4. The method of claim 1, wherein said deflecting step includes returning the at least once deflected rod-like stream into said predetermined plane prior to entry of such rod-like stream into said second path.

5. The method of claim 1, wherein said rod-like stream has a first cross-sectional area prior to said deflecting step and the deflected rod-like stream has a second cross-sectional area less than said first cross-sectional area.

6. The method of claim 1, wherein said deflecting step includes at least two successive deflecting stages and said rod-like stream has a first cross-sectional area prior to said deflecting step, and each of said at least two successive deflecting stages including a reduction of the cross-sectional area of said rod-like stream to less than said first cross-sectional area.

7. The method of claim 1, wherein said predetermined plane is a at least substantially vertical plane.

8. Apparatus for making a substantially rod-like filler of filter material for tobacco smoke, comprising a source of a continuous flow of filamentary filter material; means for advancing the filter material from said source first along a first path and thereupon along a second path through a filler processing station, said first path having a section merging into said second path; for spreading, processing and gathering successive increments of the flow in said first path ahead of said section of said first path to convert the flow into a substantially rod-like stream, said advancing means including means for maintaining the like stream in a predetermined plane along a portion of said section of said first path and means for changing the direction of movement of successive increments of the rod-like stream in said predetermined plane subsequent to gathering of said successive increments of the flow in said first path by said gathering means; and means for deflecting successive increments of said rod-like stream entirely at least once from and substantially transversely of said predetermined plane.

9. The apparatus of claim 8, wherein said predetermined plane is at least substantially vertical.

10. The apparatus of claim 8, wherein said means for deflecting includes means for repeatedly deflecting the rod-like stream in different directions.

11. The apparatus of claim 8, wherein said means for deflecting includes means for deflecting successive increments of the rod-like stream first in a first direction and thereupon in a second direction at least substantially counter to said first direction.

12. The apparatus of claim 8, wherein said means for deflecting includes at least one sheave having a circumferential groove for successive increments of the rod-like stream.

13. The apparatus of claim 8, wherein said means for deflecting includes a first sheave having a first circumferential groove of a first width and a second sheave having a second circumferential groove of a second width less than said first width, the rod-like stream being trained first over said first sheave and thereupon over said second sheave.

14. The apparatus of claim 8, wherein said means for deflecting includes a plurality of guides arranged to divert successive increments of the rod-like stream from said predetermined plane first in a first direction, thereupon in a second direction at least substantially counter to said first direction, and thereafter back into said predetermined plane.

15. The apparatus of claim 14, wherein said plurality of guides include sheaves having circumferential grooves for successive increments of the rod-like stream.

16. The apparatus of claim 8, wherein one of said means for maintaining the rod-like stream in said predetermined plane and for changing the direction of movement of said successive increments of the rod-like stream and said means for deflecting is located ahead of the other of said means for maintaining the rod-like stream in said predetermined plane and for changing the direction of movement of said successive increments of the rod-like stream and said means for deflecting, as seen in a direction of movement of successive increments of the rod-like stream under an action of said advancing means.

17. The apparatus of claim 8, wherein said source includes at least one bale and the flow being advanced from said at least one bale includes a substantially flat tow of filamentary filter material.

* * * * *